United States Patent [19]

Akman

[11] 4,159,702

[45] Jul. 3, 1979

[54] ENGINE IGNITION TIMING CONTROL WITH MULTI-STAGE ADVANCES, RETARD, AND ALTITUDE COMPENSATION FUNCTIONS

[75] Inventor: Ahmet R. Akman, Farmington, Mich.

[73] Assignee: Ford Motor Company, Dearborn, Mich.

[21] Appl. No.: 864,886

[22] Filed: Dec. 27, 1977

[51] Int. Cl.[2] ..... F02P 5/04

[52] U.S. Cl. ..... 123/117 A; 123/117 R; 123/119 A

[58] Field of Search ..... 123/117 A, 117 R, 119 A, 123/146.5 A; 60/278, 285, 290

[56] References Cited

U.S. PATENT DOCUMENTS

| | | | |
|---|---|---|---|
| 2,470,366 | 5/1949 | Ostling | 123/117 A |
| 3,626,914 | 12/1971 | Brownson et al. | 123/117 A |
| 3,704,697 | 12/1972 | Weymann | 123/117 A |
| 3,780,713 | 12/1973 | Julian | 123/117 A |
| 3,809,038 | 5/1974 | Young | 123/117 A |
| 3,865,089 | 2/1975 | Eichler et al. | 123/117 A |
| 3,895,616 | 7/1975 | Steinke | 123/117 A |
| 4,040,401 | 5/1977 | Marsee | 123/117 A |

*Primary Examiner*—Charles J. Myhre
*Assistant Examiner*—Raymond A. Nelli
*Attorney, Agent, or Firm*—Robert E. McCollum; Clifford L. Sadler

[57] ABSTRACT

A multi-stage engine ignition timing control providing dual stages of advance movement by the use of carburetor spark port vacuum applied to one diaphragm and engine driven air pump pressure applied to a second diaphragm, and the use of a constant reference pressure against one or both of the diaphragms to render the movements independent of barometric pressure changes, and including a one-way coupling to effect a retarded ignition timing setting upon switching of the actuating force acting against the one diaphragm from spark port vacuum to air pump pressure.

30 Claims, 7 Drawing Figures

ENGINE IGNITION TIMING CONTROL WITH MULTI-STAGE ADVANCES, RETARD, AND ALTITUDE COMPENSATION FUNCTIONS

This invention relates in general to an ignition timing system for an automotive type internal combustion engine. More particularly, it relates to a device that provides a multiple of functions including a dual staged timing advance through the use of spark port vacuum and engine driven air pump pressure acting on different parts of the device, a retarded timing operation resulting from switching of the spark port vacuum to air pump pressure in response to certain engine operations, and changes occasioned in whole or part without regard to barometric changes caused by increase or decrease in altitude of the vehicle in which the ignition timing control device is installed.

This particular invention is an improvement of the inventions described and shown in my copending patent applications Ser. No. 848,637, filed Nov. 4, 1977, entitled ENGINE IGNITION TIMING CONTROL, and Ser. No. 851,241, filed Nov. 14, 1977, entitled ALTITUDE INSENSITIVE AUTOMOTIVE ENGINE IGNITION TIMING CONTROL, and assigned to the assignee of this application. Ser. No. 848,637 shows an engine emission control system having a spark timing engine ignition control unit that provides a first advance of the engine timing in the conventional manner through the use of carburetor spark port vacuum that increases progressively as the throttle valve is opened to expose the spark port to the manifold vacuum level. An additional advance is effected in response to exhaust gas recirculation (EGR) between the exhaust and intake manifolds. Pressure from an engine driven air pump is operatively connected both to the EGR valve and ignition timing control to advance the timing to compensate for the decrease in burning rate caused by the EGR.

Systems are known for both controlling $NO_x$ levels and simultaneously advancing ignition timing. U.S. Pat. No. 3,809,038, R. N. Young, Exhaust Pollution Control Apparatus, illustrates schematically in FIG. 2 an emission control system in which ported manifold vacuum from a carburetor passes through a control box both to the engine ignition timing servo and to a servo controlling an exhaust gas recirculation valve. U.S. Pat. No. 3,780,713, Julian, Vacuum Operated Spark Advance Device, shows a dual advance system in which the engine ignition timing first is advanced in response to spark port manifold vacuum and then is advanced concurrently with the recirculation of exhaust gases by means of another carburetor ported EGR manifold vacuum signal.

An example of a control system in which engine driven air pump pressure is used instead of ported EGR manifold vacuum as the actuator is shown in U.S. Pat. No. 3,796,049, Hayashi, Exhaust Gas Recirculation System for an Internal Combustion Engine. An engine driven air pump provides an output pressure that is modified by manifold vacuum, the resultant being applied to open the EGR valve. However, in this case, while the air pump pressure varies with engine speed and, therefore, provides an EGR flow rate that is more proportional to the schedule the engine should follow, there is no further advancement of the ignition timing in proportion to the EGR flow to compensate for the dilution of the intake charge by the EGR gases.

Other systems for providing a dual advance of the engine ignition timing, whether to compensate for the addition of EGR or for other purposes, are shown and described in U.S. Pat. No. 4,040,401, Marsee; U.S. Pat. No. 3,626,914, Brownson; U.S. Pat. No. 3,780,713; and U.S. Pat. No. 3,915,132, Thornburgh, as well as my copending application Ser. No. 851,241. My previous application Ser. No. 851,241 further shows and describes means for rendering the device insensitive to barometric pressure changes caused by changes in altitude of the vehicle or engine in which the ignition control device is installed.

Other patent literature that is pertinent to a system of this type are U.S. Pat. No. 3,865,089, Eichler et al, and U.S. Pat. No. 3,895,616, Steinke, both of which show and describe engine ignition timing servos that provide dual retarded timing changes to compensate for cold engine operation by quickly warming catalytic converters or reactors, etc.

As will be seen, each of the prior art devices has disadvantages in that no single system is provided in which a multiple advance can be provided by the use of carburetor ported manifold vacuum signals and engine driven air pump pressures, as well as a retard timing function during cold weather operation to permit quick warm up of engine accessories, and one that also renders portions or all of the ignition timing control insensitive to barometric pressure changes caused by changes in altitude of the vehicle in which the control is installed. The prior art literature either shows dual advance ignition timing changes from an initial set position without the ability to provide a retard function and also without being insensitive to barometric pressure changes, or the device provides dual retard settings from an initial position with only a single advance movement, and again without the changes being insensitive to barometric pressure changes.

Therefore, it is a primary object of the invention to provide an engine ignition timing control that will provide multiple independent advance movements of the ignition timing control in response to different actuating forces indicative of different engine operating conditions, a retard timing movement selectively activated at a predetermined temperature level, and a construction in which a portion or all of the advance movement may be made insensitive to barometric pressure changes, which otherwise would need to be compensated for if the device were not insensitive to such changes so that the same actuating force levels can be used regardless of altitude changes.

It is another object of the invention to provide an engine ignition timing control that provides a first advance movement of the engine timing through the use of part throttle, carburetor spark port manifold vacuum changes, an additional independent advance movement of the ignition timing as a function of EGR flow by means of engine driven air pump pressure, a retard movement of the engine ignition timing by switching the spark port manifold vacuum acting on the unit to air pump pressure to activate a one way coupling in the control, and subjecting various portions of the control to a constant reference pressure so as to render all or portions of the device or control insensitive to barometric pressure changes.

Other objects, features, and advantages of the invention will become more apparent upon reference to the succeeding detailed description thereof, and to the drawings illustrating the preferred embodiments thereof; wherein, FIG. 1 is a schematic illustration of an internal combustion engine emission control system embodying the invention;

Figure 1:
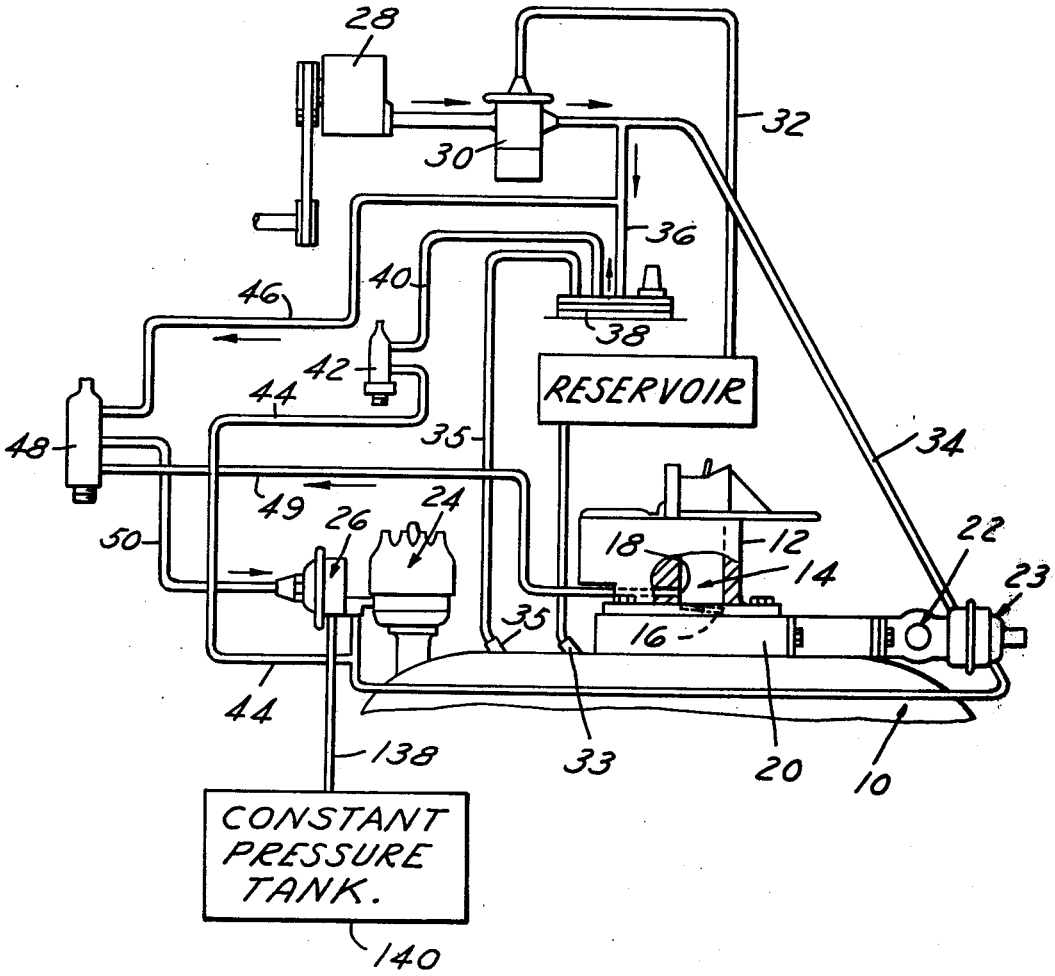

Illustrated schematically in FIG. 1 is an automotive type internal combustion engine 10 on which is mounted a downdraft type carburetor 12. The carburetor has the usual induction passage 14 through which an air/fuel mixture is fed to the engine intake manifold (not shown) past a rotatable throttle valve 16. The edge of the throttle valve traverses a so-called part throttle spark advance pressure sensitive port 18 as the throttle valve moves from the essentially closed position of the valve towards a wide open position to apply the manifold vacuum acting below the throttle valve to the progressively increasing exposed area of port 18. In the closed position of the throttle valve, port 18 will be subjected to atmospheric or ambient pressure.

Mounted on the engine between the carburetor and intake manifold is a spacer 20 of the type shown and described more clearly in U.S. Pat. No. 3,885,538, Suter, assigned to the assignee of this invention. In brief, the spacer contains a passage connecting a conventional engine exhaust gas crossover passage to the intake manifold below the carburetor induction passage riser bores to flow exhaust gases back into the engine according to a predetermined schedule. A conventional exhaust gas recirculating (EGR) valve indicated schematically at 22 is located in the passage to block or permit flow of EGR gases. The details of construction and operation of the EGR valve are not given since they are known and believed to be unnecessary for an understanding of the invention. Suffice it to say that the EGR valve is spring closed and moved to an open position by an air pump pressure controlled servo 23.

Figure 2:
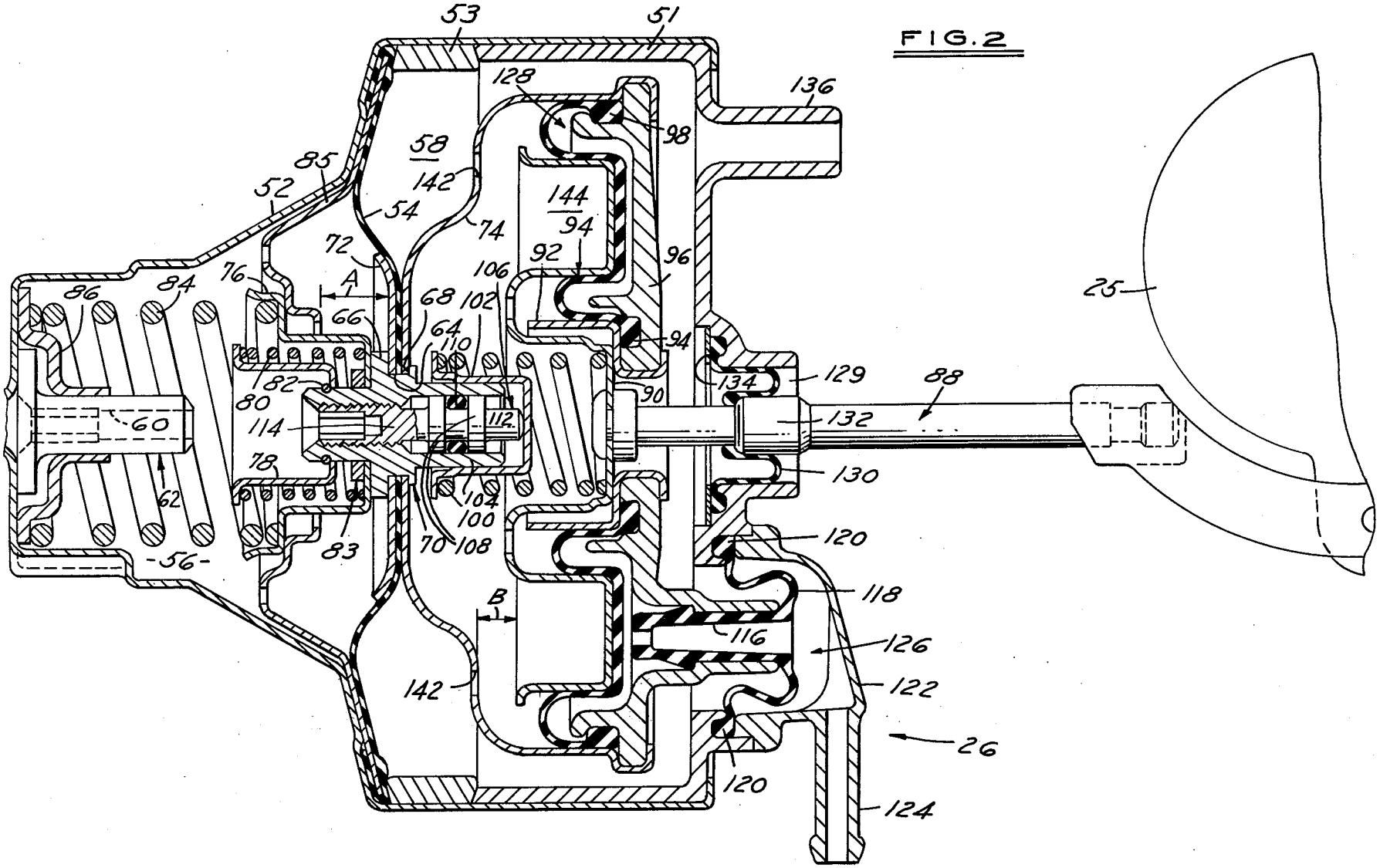
FIG. 2 is a cross-sectional view on an enlarged scale of the engine ignition timing control servo mechanism shown in FIG. 1.
Figure 3:
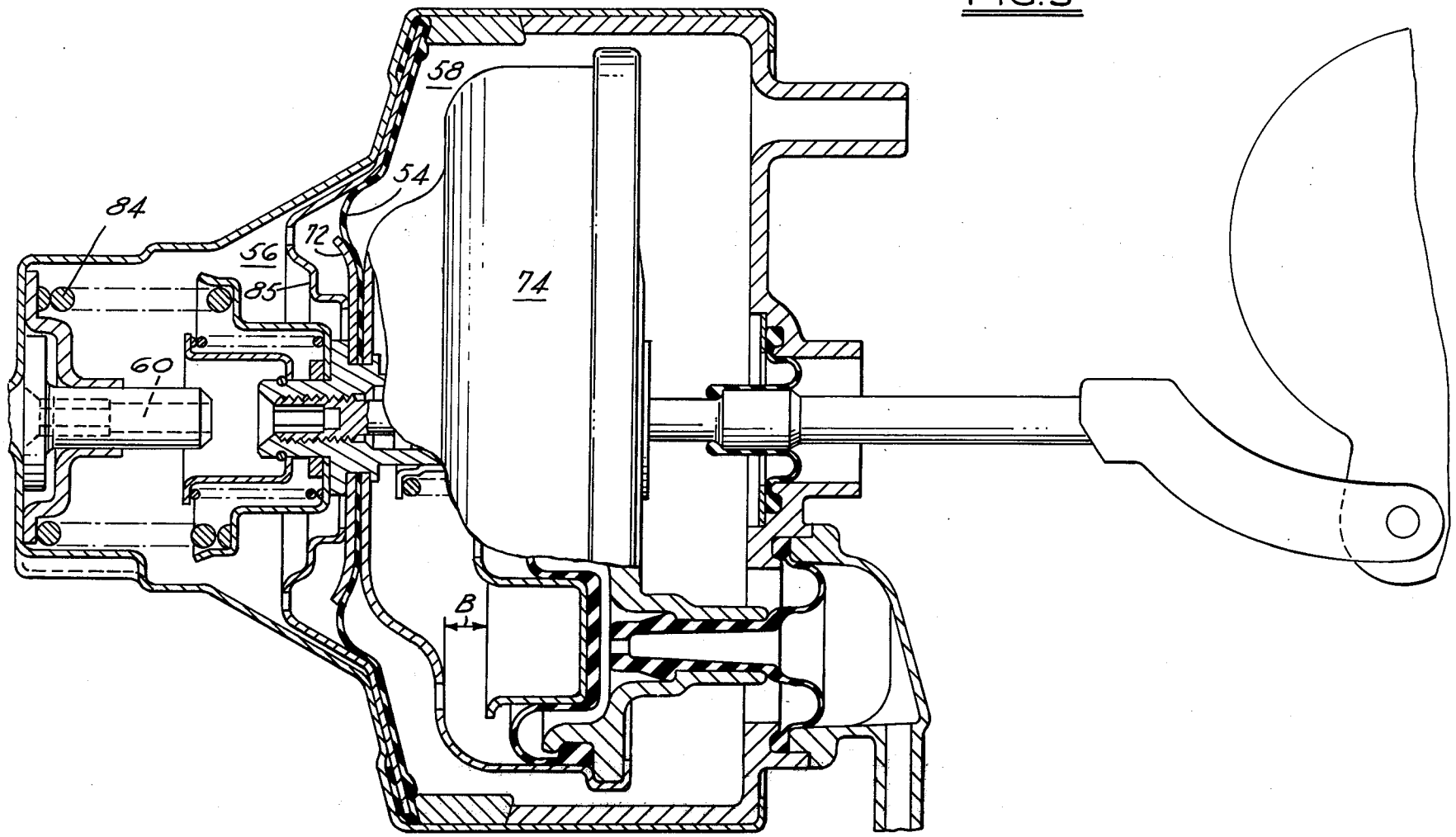
FIGS. 3–6 are cross-sectional views corresponding to that shown in FIG. 2 and illustrating the parts in various operative positions; and, FIG. 7 is a cross-sectional view of a portion of a device similar to that shown in FIG. 2 and illustrating a modified form of the invention.

Also mounted on the engine is an engine spark timing distributor mechanism 24 containing a conventional rotatable breaker plate 25 (shown partially in FIG. 3). The breaker plate in this case is adapted to be rotated in opposite directions by the servo mechanism 26 embodying the invention, illustrated schematically in FIG. 1 and in more detail in FIGS. 2–6. In brief, the servo mechanism 26 provides a stepped or multi-stage advance of the ignition timing, first in response to changes in spark port vacuum in port 18 controlled by movement of the throttle valve 16, and additionally in proportion to the flow of EGR by air pump pressure, to control engine emissions. It also provides a retarded timing by switching from spark port vacuum to air pump pressure at a predetermined temperature level. Further, all or selected of the changes, as will become apparent, are made insensitive to changes in barometric pressure due to altitude changes of the vehicle. The particular details of construction and operation of the servo mechanism 26 will be described later.

Driven by the engine is an air pump 28 providing an output super or above atmospheric pressure level that varies as a function of engine speed. The air pump is commonly provided to control emissions by providing so-called secondary air to the engine exhaust ports to combine with unburned hydrocarbons and CO to reduce them to less desirable forms. Commonly associated with the air pump is a so-called dump valve 30. The latter essentially is an on/off valve that normally permits flow to the exhaust ports except under certain engine operating conditions, when it dumps or diverts the air.

In this case, dump valve 30 is actuated at the appropriate time by vacuum in a connection 32. The latter is connected to the engine intake manifold, at 33 as shown, through the vacuum accumulator or reservoir indicated. The dump valve has a plurality of outlets for the air pump pressure, one being a line 34 to the EGR valve to open it when the pressure level is correct. A second outlet is a branched line 36, one branch of which is directed to a so-called signal conditioner 38. The signal conditioner 38 also receives an input from the engine intake manifold through a line 35. It operates to condition or modify the input air pump pressure through a line 36 as a function of the changes in manifold vacuum to provide an output pressure in a line 40 that varies both as a function of speed and load. This output pressure is supplied past a temperature sensitive control valve 42 through a line 44 to both the ignition timing control servo 26 and the EGR valve servo 23. In this way, the EGR valve will be actuated according to a schedule that varies as a function of both engine speed and load and the engine ignition timing will be simultaneously advanced.

The temperature responsive device 42 is merely a gradient opening-closing control which below a predetermined engine coolant temperature operating level blocks passage 44 to prevent EGR to provide better engine drivability and above that temperature level gradually opens so as to slowly permit the recirculation of exhaust gases and advance of the ignition timing.

The other branch 46 of line 36 supplies air pump pressure to a second temperature responsive gradient switching valve 48. The valve has a second input vacuum line 49 connected to the carburetor spark port 18, and an output line 50 connected to the ignition timing servo 26. Below an engine coolant temperature level of say 125°, for example, valve 48 connects the air pump pressure in line 46 to servo line 50 to retard the timing, for a purpose to be explained. Above 125°, valve 48 shifts to connect spark port vacuum in line 49 to servo line 50, to advance the engine timing.

Further details of construction of the devices shown in FIG. 1, except for the ignition timing servo mechanism 26, are not given since they are known and believed to be unnecessary for an understanding of the invention. Suffice it to say insofar as signal conditioner 38 is concerned, this could be of several general types, one of which is shown and described, for example, in U.S. Pat. No. 3,885,538, referred to above. In that case, air pump pressure is modified by manifold vacuum acting on a diaphragm to provide a resultant pressure operable on an EGR valve. Similarly, U.S. Pat. No. 3,796,049, referred to above, shows an air pump pressure modified by changes in intake manifold vaccum to provide a modified output pressure in a line acting on an EGR valve. In both cases, the output super or above atmospheric pressure varies essentially in inverse proprotion to increases in manifold vacuum.

FIGS. 2–6 show the details of construction of the multistage ignition timing control servo 26. More particularly, the servo consists of a main housing 51 and a bell shaped-like cover 52 between which is mounted a spacer 53. Between the spacer and cover is edge mounted an annular flexible diaphragm 54. The diaphragm acts as a common movable wall between what normally is a spark port vacuum chamber 56 and a constant pressure chamber 58. The vacuum chamber 56 is connected through a passage 60 in an adjusting screw 62 to the carburetor part throttle spark port 18 shown in FIG. 1.

The internal edge of diaphragm 54 is mounted within a recess 64 defined by flanged portions 66 and 68 of a rivet 70 between a washer 72 and the inner edge of an inner housing 74. Axially slidably mounted on rivet 70 are a pair of telescopically nesting spring retainers 76 and 78. A compression spring 80 separates the retainers, biasing the retainer 78 against a snap ring 82. This causes the rivet 70 to be biased leftwardly until flange 66 abuts retainer 76 against a second stop ring 83. A second larger part throttle compression spring 84 biases the retainer 76 against an annular stop washer 85 fixed at its outer edge between spacer 53 and cover 52.

Spring 84 thus biases the assembly consisting of the two retainers 76, 78, spring 80, rivet 70, diaphragm 54 and inner housing 74 to the initial set ignition timing position shown in FIG. 2. For a purpose that will become apparent later, retainer 78 can be moved rightwardly relative to retainer 76 to collapse spring 80 and move rivet 70 and diaphragm 54 and inner housing 74 to the right an amount equal to the distance between snap ring 82 and ring 83. The assembly consisting of retainers 76 and 78 and spring 80 thus in effect constitute a one-way coupling to rivet 70. The assembly moves leftwardly as a unit until washer 72 abuts stop washer 85. It provides a return movement the same distance to the right, as a unit, at which time retainer 78 and rivet 70 can move further to the right until retainer 78 is stopped by abutment against stop ring 83.

The opposite end of spring 84 is seated against a retainer 86. The latter is adjustably threaded onto the adjusting screw 62. A hex head tool, not shown, can be inserted into passage 60 to rotate the screw to adjust the position of retainer 86 and thus adjust the preload of spring 84.

The breaker plate 25 for distributor 24 shown in FIG. 2 has a lever 88 secured to it whereby advance movement of the breaker plate will occur in a known manner when the lever moves in a leftward direction. The leftward end of lever 88 is peened against a retainer 90 that in the position shown abuts a retainer 92. Retainer 92 clamps the inner edge of a second annular flexible diaphragm 94 between it and an inner housing backing or stop member 96. The diaphragm movement effects the additional ignition timing advance proportional to EGR flow described previously. Diaphragm 94 is washer-like having inner and outer annular edges 97 and 98. The outer edge 98 is sandwiched between the outer diameter of stop member 96 and the outer portion of the inner cover 74.

The diaphragm 94 normally is biased rightwardly as shown in FIG. 2 by a spring 100 that seats at one end against the retainer 90 and at the opposite end against a retainer 102. The retainer 102 is slidably mounted onto the sleeve end 104 of rivet 70. Slidable within the sleeve is a spool type adjuster 106 having a pair of spaced lands 108 with an annular ring seal 110 between. The adjuster has opposite end stem portions 112 and 114, the portion 112 being abutted by the retainer 102 to permit adjustment of the position of retainer 102 to vary the preload of spring 100. The opposite end stem portion 114 is threaded to cooperate with an internal thread in the rivet 70. The insertion of an allen head wrench, smaller than that needed to adjust retainer 86, can be inserted through passage 60 of screw 62 into the mating socket in rivet 70 to advance or retract the spool adjuster 106. The preloaded spring 100 then biases the secondary diaphragm 94 rightwardly until the retainer 90 abuts the retainer 92.

The construction just described above thus constitutes a second one-way coupling, this one being between the inner housing stop member 96 and the retainer 90 secured to lever 88. Advance movement of member 96 moves retainer 92 with it; however, retainer 92 may move in an advance direction to the left relative to member 96 under the influence of air pump pressure between the two, now to be described.

The modified air pump pressure or pressure from the signal conditioner 38 shown in FIG. 1 is supplied to the housing to act against the secondary diaphragm 94 through a flexible adapter 116. The latter is pushed through a formed opening in the housing stop member 96 and is part of a rolling seal 118. The edges 120 of the rolling seal are clamped to the housing 51 by an additional cover 122. The cover contains a nipple 124 connected to the air pump signal pressure line 44. The rolling seal 118 together with cover 122 form an air pressure chamber 126 that communicates with the space 128 between stop member 96 and diaphragm 94.

The annular space 129 between lever 88 and housing 51 is sealed from ambient outside pressure conditions in the FIGS. 2–6 embodiment by a second rolling seal 130. The latter is mounted internally against a boss 132 on lever 88 and externally against a shoulder on housing 51 by a retainer 134.

Housing 51 has an adapter 136 connected by a passage 138 shown in FIG. 1 to a source of air at constant pressure indicated schematically at 140. This air acts in chamber 58 and through holes 142 in inner housing 74 against the back sides of both diaphragms 54 and 94, for a purpose that will be made clear later.

The operation of the ignition control as thus far described is as follows. In FIG. 2, lever 88 is shown in an initial, engine off, set ignition timing position, which may be advanced or retarded, by a number of degrees, or at a zero position, as desired. The part throttle advance spring 84 locates the part throttle diaphragm 54 as shown with retainer 76 stopped against member 85. The preload of spring 80 is chosen such that retainer 78 will not collapse relative to retainer 76 until an aboveatmospheric pressure acts in chamber 56 on diaphragm 54.

At the same time, the secondary diaphragm spring 100 pushes the retainer 90 and lever 88 against the member 96. Ambient air pressure is present in part throttle chamber 56 and the additional advance chamber 126, 128. Constant pressure air may or may not be present in chamber 58 and the chamber 144 defined between housing 74 and diaphragm 94 depending upon whether the source 140 connected to adapter 136 is engine driven or independently supplied.

Assume now that the engine has been started and is conditioned for idle speed operation with the throttle valve in essentially closed position. Chambers 58 and 144 will be at a constant pressure level and, therefore, provide a constant reference.

FIG. 3 illustrates the condition of operation with only a part throttle spark port advance provided. Specifically, as the throttle valve is moved in FIG. 1 to uncover the spark port 18, the increasing vacuum applied to chamber 56 acting against diaphragm 54 overcomes the preload of spring 84 to collapse it moving the inner housing 74 and breaker lever 88 as a unit to the left the distance A (FIG. 2) to the position shown. The washer 72 has engaged the washer 85 and the part throttle advance movement has been halted.

Figure 4:
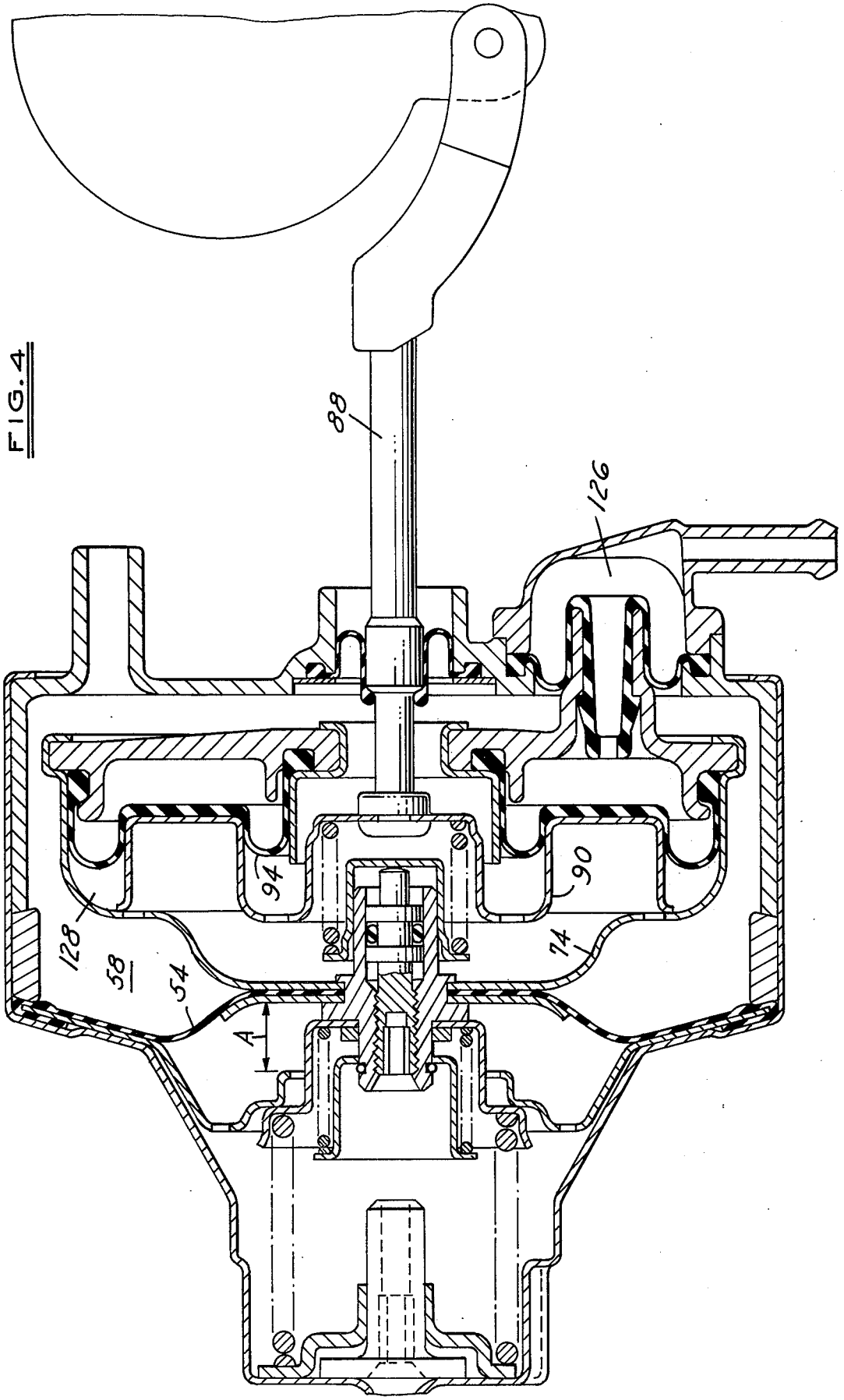

FIG. 4 illustrates the position of the parts when an advance of ignition timing is provided solely by means of the air pump pressure acting against the secondary diaphragm 94. More specifically, air pump pressure supplied to chamber 126, 128, moves diaphragm 94 leftwardly moving the retainer 90 and lever 88 with it the distance B (FIG. 2) to provide an advance movement of the distributor and engine ignition timing. This movement will continue until retainer 90 abuts the inner housing 74, at which time this advance movement of the engine ignition will be terminated.

Figure 5:
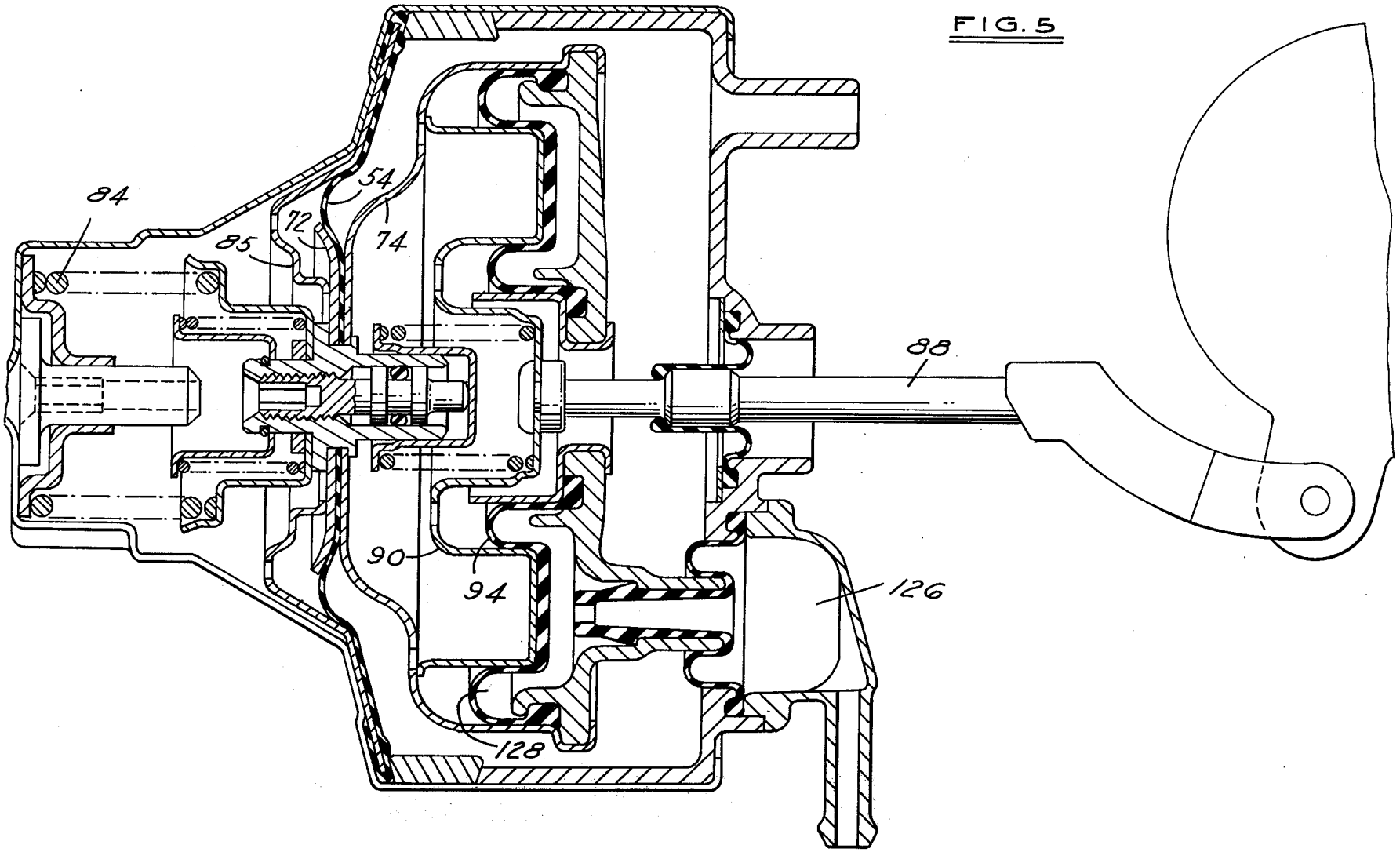

FIG. 5 shows the position of the parts when both a part throttle advance movement and an additional advance movement provided by air pump pressure occurs. More specifically, FIG. 5 shows the diaphragm 54 advanced to the left until the washer 72 abuts the washer 85, with the spring 84 collapsed to the position shown. Simultaneously, the air pump pressure in chamber 126, 128 has moved the secondary diaphragm 94 and the retainer 90 to the left until the retainer abuts the inner housing 74. Thus, a combined advance movement of the lever 88 has occurred providing a multi-advance movement of the breaker plate.

When the engine is started during cold weather operation, it is often desirable to quickly warm the catalytic converter faster than it would normally warm up a conventional engine operation. Accordingly, the engine ignition timing is retarded at this time to provide greater engine heat in the exhaust system passing to the catalytic converter.

Figure 6:
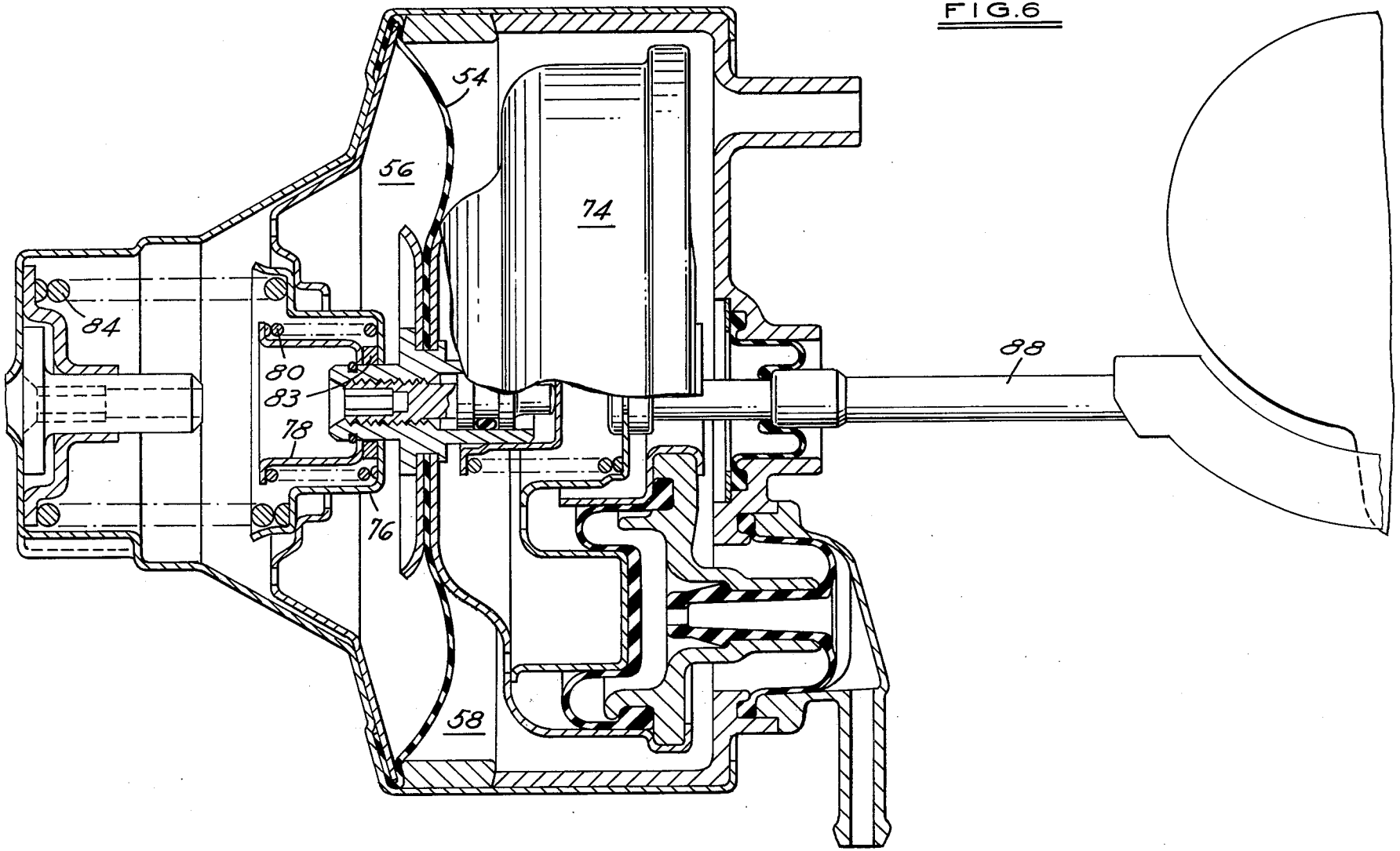

FIG. 6 illustrates the ignition timing control device in the retard mode to move beyond the initial ignition set timing position to accomplish the above objective. More particularly, referring to FIG. 1, as the temperature decreases below 125°, for example, the switch 48 moves to change the spark port vacuum in line 49 leading to chamber 56 to air pump pressure from line 46. Accordingly, the air pump pressure now acting in chamber 56 against diaphragm 54 pushes the diaphragm against the constant reference pressure in chamber 58. The differential force on the diaphragm at this time is sufficient to overcome the preload of spring 80 and collapse it by pulling retainer 78 rightwardly towards the retainer 76 until the retainer 78 abuts spacer 83. The movement just described thus provides a retarded ignition timing movement of lever 88 through movement of the one-way coupling and inner housing 74 to provide the additional heat desired in the exhaust system.

It will be clear, of course, that various advance and retard operations described can be obtained either independently or concurrent with other operations so as to provide multistage advance, retard functions as desired. As stated previously, chambers 58 and 144 (FIG. 2) are indicated as at a constant pressure level by virtue of the apertures 142 connecting the two chambers.

Figure 7:
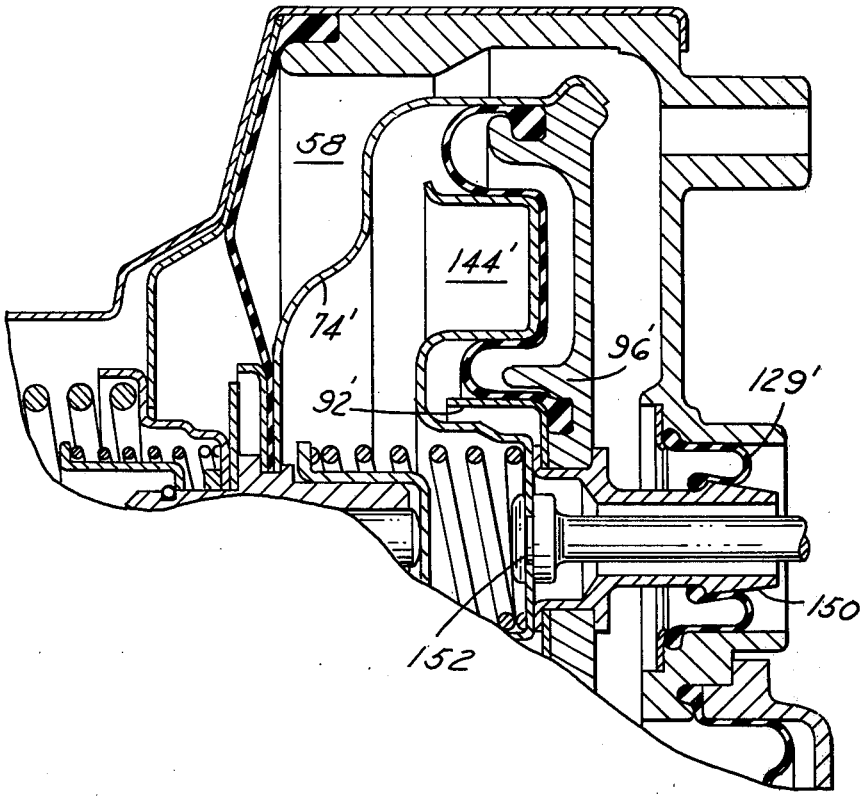

FIG. 7 shows a further embodiment in which only the part throttle advance movement of the lever 88 is made insensitive to barometric pressure changes caused by changes in altitude of the vehicle in which the device is installed. More particularly, FIG. 7 shows the inner housing 74' as having no apertures 142 as shown in FIG. 2 so that communication between chambers 58 and 144 is prevented. Also, the rolling seal 129 shown in FIG. 2 is replaced by a seal 129' in FIG. 7 connected to a sleeve adapter member 150 instead of to lever 88 so that ambient or atmospheric air may pass between the lever 88 and the sleeve and into chamber 144' through aperture 152. The sleeve is connected at its leftward end to the retainer 92' and inner edge of stop member 96'.

From the above, it will be seen that the invention provides an engine ignition timing control that provides not only a plurality of advance movements independently or concurrent, but also a retard movement beyond the initial ignition set timing position, and other controls to render all or portions of the control insensitive to barometric pressure changes due to altitude changes of the vehicle in which the control is installed.

With respect to the latter, as to the FIGS. 2–6 embodiment, each vacuum level in chambers 56 and 144 will provide the same travel movement of lever 88 regardless of ambient/atmospheric pressure conditions because the reference pressure on the opposite sides of the diaphragms 54 and 94 in chambers 56 and 128 is constant. Thus, even though the vehicle moves between higher and lower altitudes, with a consequential change in barometric pressures, the diaphragm travels will remain the same for the same vacuum force applied.

The overall operation of the system shown and described in connection with FIG. 1 is believed to be clear from the above and, therefore, will not be repeated.

While the above invention has been shown and described in its preferred embodiments, it will be clear to those skilled in the art to which it pertains that many changes and modifications may be made thereto without departing from the scope of the invention. For example, in FIGS. 1 and 2, another switch could be located in the line 138 leading to adapter 136 and normally constant pressure chamber 58 so that at the desired time, atmospheric pressure could be substituted for the constant pressure source air. This would immediately bring the lever 88 to the right to the initial set timing position, for example, or may move it to a retarded setting.

I claim:

1. A multi-stage ignition timing control for an internal combustion engine having a carburetor mounted thereon with an induction passage connected to the engine intake manifold and having a throttle valve movable to open and close the passage, a pressure sensitive part throttle spark port opening into the passage and adapted to be traversed by the edge of the throttle valve during its opening movement to progressively vary the pressure in the port from a maximum ambient/atmospheric pressure level to the level of the manifold vacuum, an engine driven air pump providing a source of above atmospheric pressure that varies as a function of changes in engine speed, a distributor ignition timing change means having movable lever means in an initial set engine timing position movable in an advance direction from the set position to advance the ignition timing and movable in an opposite retard direction to return the lever means to the set position and beyond to retard the ignition timing, and a servo mechanism having diaphragm means operatively connected to the distributor lever means for moving the same in response to the application of the various pressures to the diaphragm means, conduit means connecting the pressure from the spark port and air pump to the servomechanism to act on the diaphragm means, first means in the servomechanism providing an advance movement of the lever means in response to the application of spark port vacuum to the diaphragm means, second means in the servomechanism providing an advance movement of the lever means in response to the application of above atmospheric pressure from the air pump to the diaphragm means, and third means in the servomechanism providing a retard movement of the lever means from the set position in response to the switching of spark port vacuum to air pump pressure to act on the first means.

2. A control as in claim 1, the third means including spring means biasing the diaphragm means and lever means to the initial set position, stop means in the path of movement of the diaphragm means to normally stop movement of the diaphragm means in the set position, and other means permitting an additional movement of the diaphragm means and lever means in the retard direction beyond the initial set position to retard the engine timing.

3. A control as in claim 2, the other means being air pump pressure actuated.

4. A control as in claim 2, the other means including a yieldable connection between the diaphragm means and the stop means.

5. A control as in claim 4, the yieldable connection including a preloaded spring.

6. A control as in claim 2, the other means comprising a pair of axially telescopically nested members having a spring axially spacing the members, means connecting one member to the diaphragm means and locating the stop means in the path of movement of the other member.

7. A control as in claim 6, including a housing, the diaphragm means including a diaphragm with the housing defining a first member alternately connectable to the spark port vacuum and air pump pressure, and switch means for switching the connection of the first chamber from spark port vacuum to air pump pressure to effect a movement of the lever means to a retard position to effect a change in timing from advanced to retarded.

8. A control as in claim 7, the switch means being temperature responsive and operable in response to a decrease in temperature below a predetermined level.

9. A control as in claim 6, the spring means acting against the other member biasing the other member against the stop means.

10. A control as in claim 7, the pair of members being contained within the first chamber.

11. A control as in claim 7, the diaphragm with the housing also defining a second chamber, and a source of constant pressure connected to the second chamber.

12. A control as in claim 2, including a housing, the diaphragm means including a diaphragm with the housing defining a first chamber alternately connectable to the spark port vacuum and air pump pressure, and switch means for switching the connection of the first chamber from spark port vacuum to air pump pressure to effect a movement of the lever means to a retard position to effect a change in timing from advanced to retarded.

13. A control as in claim 12, the diaphragm with the housing defining a second chamber, an inner housing within the second chamber secured to the diaphragm, a second diaphragm dividing the inner housing into an air pump pressure chamber and another chamber, and one-way connecting means between the inner housing and lever means permitting relative movement therebetween at times and concurrent movement therebetween at other times to provide various degrees of timing advance movement of the lever means.

14. A control as in claim 13, including second spring means biasing the lever means towards engagement with the inner housing.

15. A control as in claim 14, including a source of constant pressure, and means connecting the source to the second chamber.

16. A control as in claim 15, including means connecting the constant pressure source to the another chamber.

17. A multi-stage ignition timing control for an internal combustion engine having a carburetor mounted thereon with an induction passage connected to the engine intake manifold and having a throttle valve movable to open and close the passage, a pressure sensitive part-throttle spark port opening into the passage and adapted to be traversed by the edge of the throttle valve during its opening movement to progressively vary the pressure in the port from a maximum ambient/atmospheric pressure level to the level of the manifold vacuum, an engine driven air pump providing a source of aboveatmospheric pressure that varies as a function of changes in engine speed, a distributor ignition timing change means having lever means in an initial engine timing set position movable from the set position in an advance direction to advance the ignition timing and movable in an opposite retard direction to return the lever means to the set position and beyond to a retard positon to retard the ignition timing, and a servomechanism having diaphragm means operatively connected to the distributor lever means for moving the same in response to the various pressures operatively applied thereto, the servomechanism including a hollow outer housing, the diaphragm means including a first flexible diaphragm with the outer housing defining a first spark port vacuum chamber, first conduit means connecting the spark port vacuum to the first chamber to act on one side of the diaphragm to move the diaphragm in an advance direction, alternately operable switch means in the first conduit means, second conduit means connecting air pump pressure to the switch means whereby operation of the switch means in one mode normally connects spark port vacuum to the first chamber, and operation of the switch means in the alternate mode connects air pump pressure to the first chamber to act on the diaphragm to move it in a retard direction to and beyond the initial set position to a retarded timing setting, spring means operatively biasing the diaphragm to the initial set position, stop means in the path of movement of the spring means for determining the initial set position of the diaphragm, and yieldable means between the spring means and diaphragm permitting additional movement of the diaphragm in a retard direction beyond the initial set position in response to air pump pressure acting on the one side of the diaphragm upon operation of the switch means in the alternate mode.

18. A control as in claim 17, the yieldable means comprising a spring separated pair of axially aligned nestable members, one member being connected to the diaphragm, the other member being acted upon by the spring means.

19. A control as in claim 17, the yieldable means comprising a one-way collapsible coupling between the spring means and diaphragm.

20. A control as in claim 17, including a hollow inner housing, the diaphragm means including a second flexible diaphragm operatively connected to the distributor lever means and with the inner housing defining an above atmospheric air pump pressure chamber connected to the air pump to be responsive to changes in engine speed for actuating the lever means in an advance direction.

21. A control as in claim 17, the diaphragm and housing defining a second fluid chamber, a source of constant pressure, and conduit means connecting the constant pressure source to the second chamber to render the first diaphragm movement insensitive to barometric pressure changes.

22. A control as in claim 20, including one-way coupling means between the inner housing and lever means causing concurrent movement of the lever means and inner housing upon movement of the first diaphragm in an advance direction in response to an increase in spark port vacuum level, and an independent movement of the lever means and second diaphragm in an advance direction relative to the inner housing in response to an increase in air pump pressure in the air pump pressure chamber.

23. A control as in claim 20, the first diaphragm and outer housing defining a second fluid chamber, a source of constant pressure, the second diaphragm constituting a common wall between the air pump pressure chamber and another chamber, and means connecting the constant pressure to the second chamber and other chamber to render the movements of the first and second diaphragms responsive to changes in spark port vacuum level and air pump pressure level alone and insensitive to barometric pressure changes effected by altitude changes of the vehicle in which the control is installed.

24. A control as in claim 20, including means to apply air at ambient pressure conditions against the side of the second diaphragm opposite the air pump pressure chamber side.

25. A control as in claim 17, the diaphragm means including a second flexible diaphragm operatively connected to the lever means and dividing the inner housing into an above atmospheric pressure chamber connected to the air pump and an ambient air pressure chamber.

26. A control as in claim 25, the first diaphragm and outer housing also defining a second fluid chamber, and a source of pressure at a constant level connected to the second chamber rendering the part throttle advance movement of the first diaphragm and lever means sensitive to spark port vacuum and air pump pressure changes alone and insensitive to barometric pressure changes.

27. A control as in claim 23, including sealing means between the outer housing and lever means for preventing the admission of ambient pressure air to the chambers.

28. A control as in claim 25, including means providing a clearance space between the lever means and inner housing for the inlet of outside ambient pressure air communicating through the space to the ambient air pressure chamber.

29. A control as in claim 25, the diaphragm and outer housing also defining a second chamber, air flow means surrounding the lever means spacing the lever means from the inner housing, means communicating one end of the air flow means to ambient pressure air and connecting the other end to the ambient air pressure chamber, and seal means between the outer housing and inner housing and air flow means to seal the second chamber from the ambient pressure air.

30. A control as in claim 29, including a source of pressure at a constant level, and means connecting the latter source to the second chamber to render the movement of the first diaphragm sensitive only to part throttle spark port vacuum changes and air pump pressure changes and insensitive to barometric ambient pressure changes.

* * * * *